US005709378A

United States Patent [19]

Snook

[11] Patent Number: 5,709,378

[45] Date of Patent: Jan. 20, 1998

[54] MECHANISM FOR COUNTING STACKED SHEETS

[75] Inventor: Martin Gordon Snook, Colchester, Great Britain

[73] Assignee: Pelcombe Limited, Great Britain

[21] Appl. No.: 640,938

[22] PCT Filed: Nov. 3, 1994

[86] PCT No.: PCT/GB94/02416

§ 371 Date: May 3, 1996

§ 102(e) Date: May 3, 1996

[87] PCT Pub. No.: WO95/12561

PCT Pub. Date: May 11, 1995

[30] Foreign Application Priority Data

Nov. 6, 1993 [GB] United Kingdom ..... 9322903

[51] Int. Cl.[6] ..... B65H 3/08

[52] U.S. Cl. ..... 271/100; 271/106; 235/98 R

[58] Field of Search ..... 221/182; 271/100, 271/107, 3.04, 101, 184, 106; 235/89 R, 98 R

[56] References Cited

U.S. PATENT DOCUMENTS

| | | | |
|---|---|---|---|
| 3,801,777 | 4/1974 | Onoe et al. | 271/100 |
| 5,133,540 | 7/1992 | Suzuki et al. | 271/104 |

FOREIGN PATENT DOCUMENTS

| | | | |
|---|---|---|---|
| 1048075 | 12/1953 | France . | |
| 1231724 | 1/1967 | Germany | 275/100 |
| 1426523 | 5/1976 | United Kingdom . | |
| 2106871 | 4/1983 | United Kingdom | 271/106 |

*Primary Examiner*—H. Grant Skaggs

*Attorney, Agent, or Firm*—Andrus, Sceales, Starke & Sawall

[57] ABSTRACT

A sheet counter has a blade (13) for insertion between adjacent sheets of a stack thereof, and a pin (15) which orbits around the blade to transfer sheets from one side of the blade to the other. A carrier (37) defines three axes disposed in a generally triangular arrangement, the pin (15) being mounted on one of the axes, and the carrier being coupled to a crank (36) about another axis. A link (42) is pivoted at one end to the carrier (37) and at its other end to a fixed part of the counter. As the pin (15) orbits around the blade (13) on rotation of crank (36), the blade is oscillated about an axis adjacent the edge inserted furthest into the sheet stack by a crank (30) and connecting rod (31), driven synchronously with crank (36). Suction is applied in a timed manner to a hole (45) in the blade (13), to assist the separation of the sheets one at a time, before the transfer thereof to the other side of the blade by pin (15).

15 Claims, 3 Drawing Sheets

MECHANISM FOR COUNTING STACKED SHEETS

This invention relates to a sheet counter, and in particular to a counter intended to count the number of sheets in a stack by operating on a corner region of that stack.

A known form of sheet counter has an elongate element usually in the form of a blade, and an elongate member arranged with its axis substantially parallel to that of the element and mounted to orbit around the element. During this orbiting movement, the element performs a synchronised essentially-rocking movement. The element has at least one port in its outer surface through which air is drawn by a low pressure source. Counting is performed by positioning the element at the corner region of one end of the stack of sheets to be counted, drawing air through the port and then driving the pin to orbit round the element whilst simultaneously rocking the element, thereby transferring sheets from one side of the element to the other. Such a sheet counter will hereinafter be referred to as a "sheet counter of the kind described".

In a sheet counter of the kind described, it is usual to generate a count signal by monitoring the pressure in a duct connected to the port in the elongate element. Each time a sheet corner is pulled onto the element by the air being drawn through the port, that port is covered and the pressure in the duct will drop. This drop in pressure can be detected and used to produce a count signal. A reduction in erroneous counts may be achieved by including a position sensor for the elongate member, whereby a count signal may be regarded as valid only if it is generated at the time a sheet to be counted may be expected to lie over the port.

Usually, in a sheet counter of the kind described, the elongate member is in the form of a pin. Often, the elongate element is in the form of a blade since this allows the easy insertion thereof into the corner region of a stack of sheets to be counted. In order to minimise the separation of sheets to each side of the counter in a stack, it is desirable for the motion of the pin closely to follow the surface of the blade, which latter usually performs a rocking motion. In this case, the motion of the pin around the blade has to be complex and various mechanisms have been designed to achieve this.

One design of such a mechanism is disclosed in GB-1,426,523-A. This mechanism aims at having the pin more closely follow the outer periphery of the blade whilst that blade itself performs a rocking movement, in order to minimise the required separation of sheets in the corner region of a stack. In GB-1,455,109-A a more complex mechanism is disclosed, and yet another mechanism is disclosed in GB-2,106,871-A. Here, the rocking movement of the blade has been increased in order to enhance the sheet-separation characteristics of the counter and so to reduce the likelihood of erroneous counts, but the required mechanism to have the pin closely follow the movement of the blade is necessarily complex.

In all the prior art designs, the mechanisms are complex and relatively large. The complexity gives rise to lower reliability and the appropriate adjustment of the mechanisms can be difficult to set accurately. The physical size of the prior designs does not allow for the production of a compact unit, which therefore leads to further difficulties in controlling the vertical movement of the counter and its positioning closely adjacent a corner region of a stack of sheets to be counted.

The present invention results from attempts to reduce the complexity and physical size of the linkage required to cause the pin to perform an orbit around the outer surface of a blade, whilst at the same time allowing that blade to perform a relatively large rocking movement to enhance sheet separation.

According to the present invention, there is provided a sheet transfer mechanism comprising an elongate element adapted for insertion into the corner region of a stack of sheets, an elongate member arranged to extend substantially parallel to the elongate element, and means mounting the elongate member to orbit around the elongate element thereby to transfer sheets from one side of the elongate element to the other side thereof, which mounting means comprises:

- a carrier defining three parallel axes arranged in a triangular configuration, the elongate member being disposed along one of said axes;
- a link pivotally connected to the carrier about a second of said axes which link is also pivoted to a fixed part of the mechanism; and
- a rotatable crank drivingly coupled to the carrier about a third of said axes whereby rotation of the crank causes the elongate member to perform said orbiting motion;

characterised in that said three parallel axes are arranged in a triangular configuration, the spacing between the parallel axes, in each case when taken in pairs (38-39, 39-40, 38-40), all being of the same order of magnitude.

It will be appreciated that the mechanism of this invention is relatively simple and may be constructed in a most compact manner. Relatively few pivots are required and yet a complex motion for the elongate member may be generated. The actual orbit performed by the member may be adjusted by varying the distances between the axes of the carrier, as well as the length of the link and the throw of the crank; and further adjustment may be achieved by varying the position of the link pivot on the frame. By appropriate configuration of these parameters, it is found that a particularly advantageous elongate member motion may be achieved.

In a preferred arrangement, the effective length of the link is of the same order of magnitude as the spacing between each pair of axes defined by the carrier—that is to say, any one of the dimensions is no more than twice or less than half any other dimension. By contrast, it is preferred for the throw of the crank to be of the order of one third to one half of any one of those dimensions.

The motion of the elongate member may be optimised by arranging the line of projection of the link from the carrier to be generally in the same direction as the location of said one axis of the carrier with respect to the line joining the second and third axes of the carrier. Of course, as the carrier performs its complex motion, both the link and the carrier will be moving with respect to each other, but nevertheless the link may still generally project in this defined direction.

As with the prior art arrangements, it is most advantageous for the elongate element to be mounted on a support which is arranged to perform a rocking motion as the elongate member orbits therearound. Preferably, the elongate element is in the form of a blade, in which case the rocking motion imparted to the blade may be centred on an axis lying along or adjacent the edge of the blade which is inserted deeper into the corner region of a stack of sheets to be counted.

It is preferred for the angular movement of the blade to be relatively large to ensure reliable sheet separation, and typically may be as large as is shown in our prior Specification No. GB-2,106,871-A. To this end, the support may be pivoted to a fixed part of the mechanism, a rotatable crank being coupled by an arm to the support so as to cause the support to perform said rocking movement upon rotation of the crank.

In a preferred form of sheet transfer mechanism of this invention, there are two spaced frame parts, the elongate member being mounted on one frame part and projecting towards the other frame part, and the elongate element being mounted on the other frame part and projecting towards the one frame part. In such a case, the two cranks may be driven by a common motor, so as to rotate in synchronism. Conveniently, this may be achieved by providing a lay-shaft extending through the two frame parts and coupled by respective non-slip drive trains of the same velocity ratio to the two cranks.

In the just-described construction, the lay-shaft may also serve to mount the transfer mechanism for pivoting movement with respect to a principal frame, by providing bearings on the ends of the lay-shaft, which bearings are mounted on the principal frame. By making the bearings readily attachable to and detachable from the principal frame, the sheet counting head may be removed from that frame whenever required. Alternatively, the principal frame may be mounted within an overall sheet counter in such a way as to be readily removable should the need arise. In either case, an appropriate servo-mechanism may be arranged to raise or lower the sheet-counting head as a whole, in response to movement of the head about the axis of the lay-shaft, to allow the elongate member to advance through a corner region of a stack of sheets to be counted.

By way of example only, one specific embodiment of sheet transfer mechanism of the invention will now be described with reference to the accompanying drawings, in which.

Figure 1:
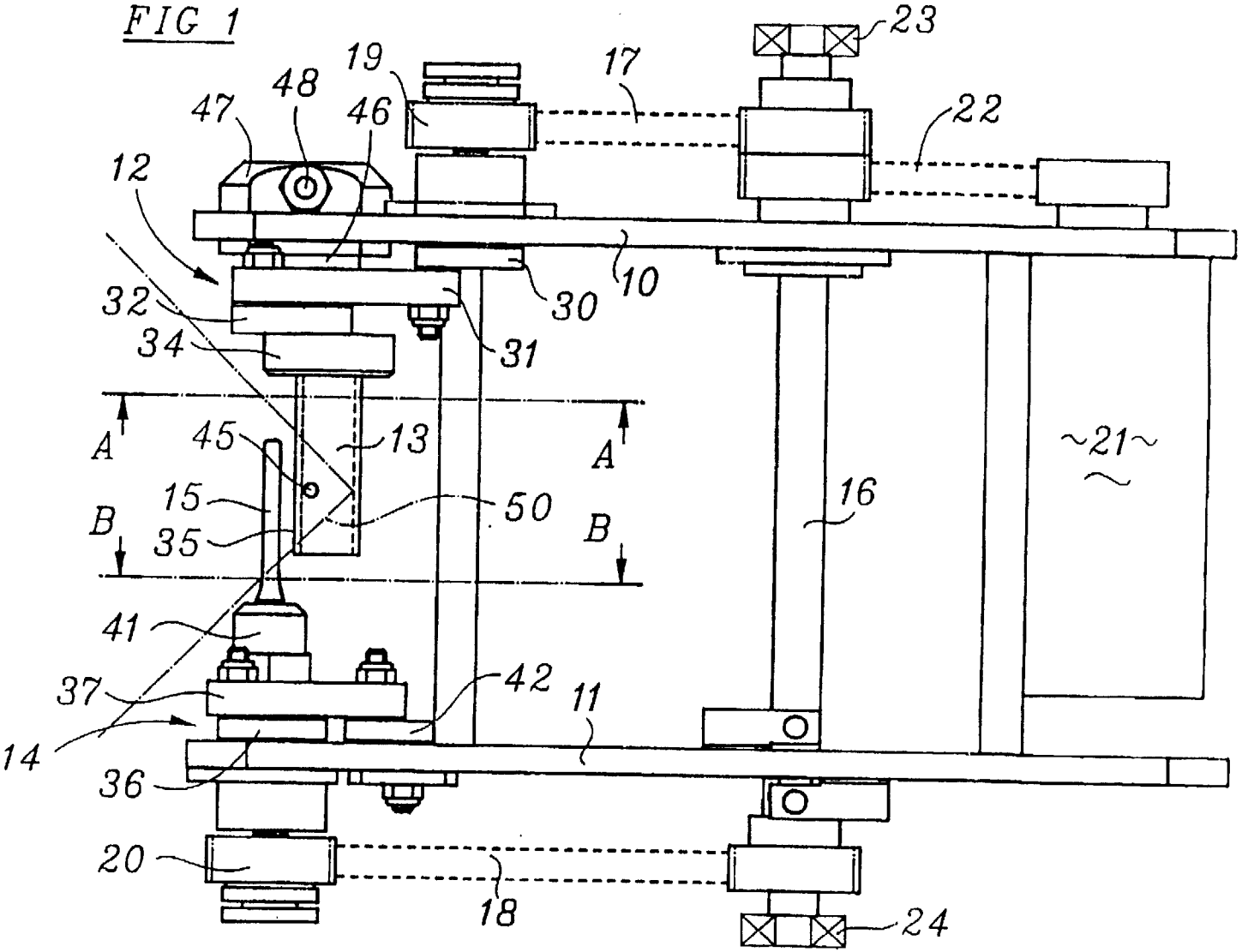
FIG. 1 is a plan view of the embodiment of sheet transfer mechanism.

The sheet transfer mechanism comprises a frame having a pair of side plates 10 and 11 held by cross-members in a parallel spaced-apart disposition. Side plate 10 supports a first drive mechanism 12 for a rocking blade 13 and side plate 11 supports a second drive mechanism 14 for a pin 15 which is arranged to orbit around the blade 13. Both drive mechanisms 12 and 14 are driven from a common lay-shaft 16 by means of respective toothed belts 17 and 18 coupled to respective input pulleys 19 and 20. The lay-shaft 16 is journalled in the side plates 10 and 11 and is driven by an electric motor 21 mounted on side plate 10, coupled to the lay-shaft 16 by means of a further toothed belt 22.

The lay-shaft 16 extends beyond the pulleys around which the toothed belts 17 and 18 pass, and carries at its free ends ball races 23 and 24. These ball races are used to mount the overall transfer mechanism on a principal frame of a sheet-counter.

Figure 2:
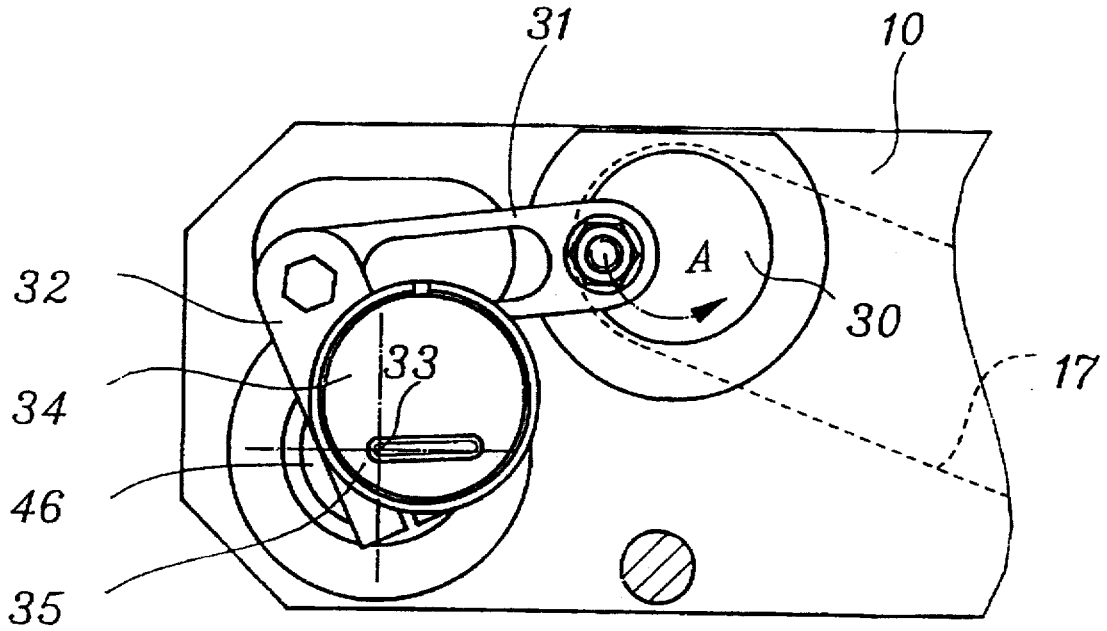
FIG. 2 is a sectional view taken on line A—A marked on FIG. 1.

The first drive mechanism 12 is also shown in FIG. 2, and comprises a crank 30 mounted on the same shaft as input pulley 19, to be driven thereby. A connecting rod 31 is pivoted to the crank 30 and also to an arm 32 which is itself mounted for pivoting movement about axis 33. The arm 32 supports an adjustable boss 34 on which is supported the blade 13, disposed so that the axis 33 is closely adjacent the front edge 35 of the blade. The boss 34 is adjustable about its own axis, to allow the position of the blade 13 with respect to axis 33 to be adjusted, in order to optimise the counting of sheets.

Figure 4:
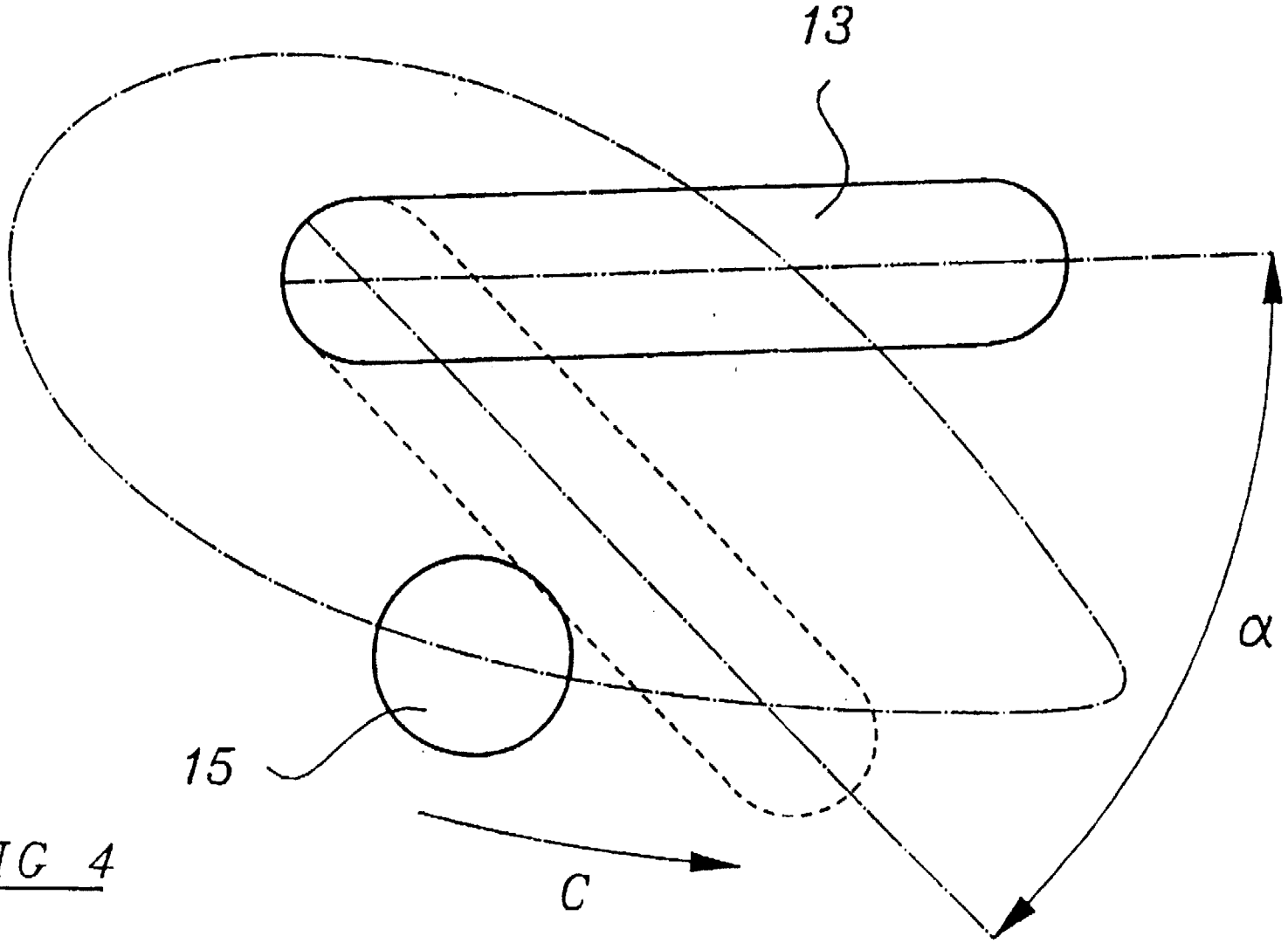
FIG. 4 is a diagram illustrating the rocking movement of the blade and the orbiting movement of the pin.

Rotation of the crank 30 in the direction of arrow A causes the blade 13 to perform a rocking motion, as illustrated in FIG. 4, through an angle $\alpha$.

Figure 3:
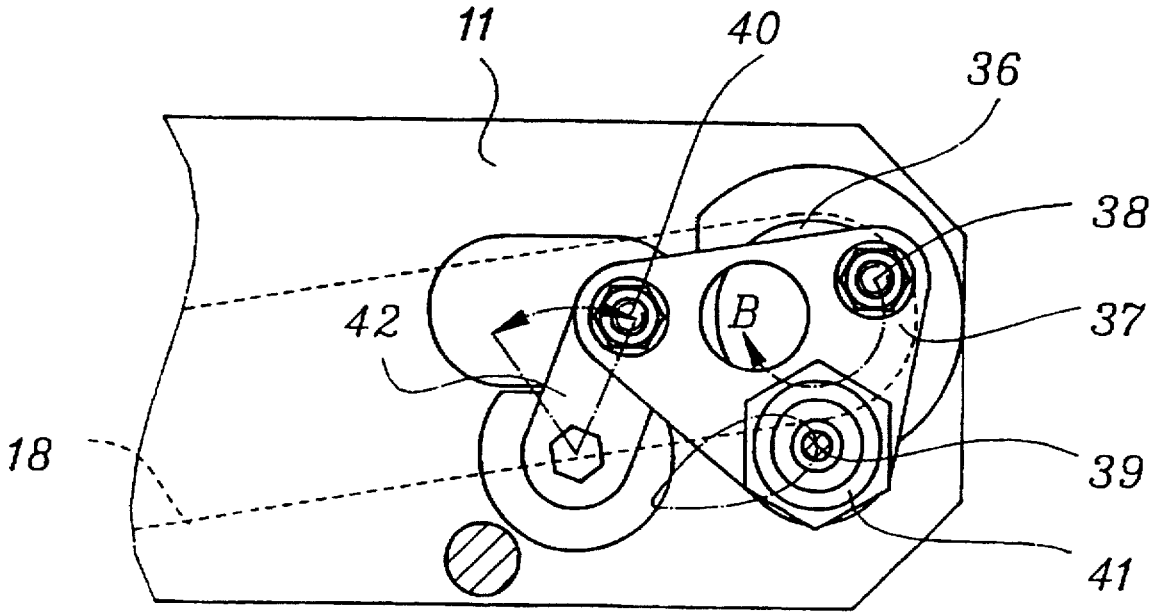
FIG. 3 is a sectional view taken on line B—B marked on FIG. 1.

The second drive mechanism 14 is shown in FIG. 3 and comprises a crank 36 mounted on the same shaft as input pulley 20, to be driven thereby. A carrier 37 is pivoted to the crank 36 about one axis 38, and defines two further axes 39 and 40, the three axes being disposed in a triangularly-arranged configuration. The elongate pin 15 is rotatably mounted by bushing 41 to extend along axis 39, and a link 42 is pivoted adjacent one end to the carrier 37, about axis 40. The link 42 is also pivoted to side plate 11, adjacent the other end of the link. Though not shown in FIG. 3, the pivoting connection to the side plate 11 may be made adjustable, for example by providing a slot in the side plate 11, or by providing an adjustable eccentric mounting on the side plate, to permit adjustment of the locus described by-the pin 15 during operation of the second drive mechanism 14.

Rotation of the crank 36 in the direction of arrow B causes the pin 15 to perform a complex orbiting motion about the blade 13, as illustrated in FIG. 4. This motion is generated as a consequence of the four-bar linkage comprised by the crank 36, carrier 37 and link 42 together with the side plate 11, and by the particular relative disposition of the link with respect to the carrier and also the spacings of the axes 38, 39 and 40 as well as the length of the link 42 and the throw of the crank 36. Appropriate selection of these various parameters allows the orbit of the pin 15 to be controlled and optimised to suit the physical size of the blade 13, and its rocking motion.

In the arrangement illustrated in the drawings, the effective length of the link 42, and the spacing between any pair of axes 38, 39 and 40, are all of the same order of magnitude; and in a specific embodiment these dimensions all lie within the range of 24 mm to 41 mm. The throw of the crank 36 is typically of the order of one half of the dimensions referred to above and in a specific embodiment is approximately 12 mm. The position of the pivot of the link to the side plate 11 is selected so that the link extends generally in the same direction from axis 40 as is axis 39 with respect to the line between axes 38 and 40—but of course the relative dispositions of these components vary as the mechanism operates.

The blade 13 has a suction port 45 in its upper surface, adjacent the leading edge 35. That port is connected internally through the blade 13, boss 34, arm 32 and shaft 46 pivotally mounting that arm on side plate 10, to a housing 47, to which is connected a vacuum pipe 48. Air is thus drawn through port 45 during operation of the transfer mechanism.

In FIG. 1, there is shown the corner region of a stack of sheets 50, illustrating the insertion of the blade 13 into that corner region. Sheets are transferred one at a time from above the blade 13 so as to lie therebelow, during operation of the sheet transfer mechanism. A sheet is picked up by the blade and held to that blade by the low pressure an port 45, when the blade 13 lies in the position shown in solid lines in FIG. 4. The pin 15 is, at this time, in the position also shown in solid lines in FIG. 4. The blade then moves to the position shown in broken lines, pulling with it the corner region of the picked-up sheet, whilst the pin moves in the direction of arrow C around its orbit. The pin then passes over the corner region of the picked-up sheet, to separate that sheet from the stack thereabove, and transfers that sheet to the stack of sheets accumulating below the blade, as the pin moves back to its position shown in solid lines. This cycle of operation is repeated until all the sheets in the stack have been counted.

In view of the relatively compact mechanism having few moving parts, it may exhibit high reliability and be operated at relatively high speeds. Preliminary trials have shown that count speeds as high as 3000 sheets per minute may be obtained when counting paper.

I claim:

1. A sheet transfer mechanism comprising an elongate element (13) adapted to operate on the corner region of a stack of sheets; a suction port (45) being provided in a region of the elongate element (13) which region generally faces uncounted sheets in the stack, means to apply suction to said port to separate a next sheet to be counted from the stack and draw said next sheet on to the elongate element, an elongate member (15) arranged to extend substantially parallel to the elongate element (13), and means mounting the elongate member (15) to orbit around the elongate element (13) thereby to transfer sheets from one side of the elongate element to the other side thereof, which mounting means comprises:

a carrier (37) defining three parallel axes (38, 39, 40), the elongate member (15) being disposed along one of said axes (39);

a link (42) pivotally connected to the carrier (37) about a second of said axes (40) which link (42) is also pivoted to a fixed part (11) of the mechanism; and a rotatable crank (36) drivingly coupled to the carrier (37) about a third of said axes (38) whereby rotation of the crank (36) causes the elongate member (15) to perform said orbiting motion;

characterized in that said three parallel axes (38, 39, 40) are arranged in a triangular configuration, the spacing between the parallel axes, in each case when taken in pairs (38-29, 29-40, 38-40), all being of the same order of magnitude.

2. A sheet transfer mechanism as claimed in claim 1, wherein the effective length of the link (42) is of the same order of magnitude as said spacing between the parallel axes (38, 38, 40).

3. A sheet transfer mechanism as claimed in claim 2, wherein the throw of the crank (36) is of the order of one third to one half of any of the effective length of the link (42) and the spacing between any pair of axes (38-39, 39-40, 38-40) defined by the carrier (37).

4. A sheet transfer mechanism as claimed in claim 2, wherein the line of projection of the link (42) from the carrier (37) is generally in the same direction as a line connecting the third axis (38) and the one axis (39).

5. A sheet transfer mechanism as claimed in claim 1, wherein the elongate element (13) is mounted on a support (32) which is arranged to perform a rocking motion as the elongate member (15) orbits therearound.

6. A sheet transfer mechanism as claimed in claim 5, wherein the elongate element (13) is in the form of a blade, and the rocking motion imparted to the blade is centered on an axis (33) lying along or adjacent the edge of the blade which is inserted deeper into the corner region of a stack of sheets to be transferred.

7. A sheet transfer mechanism as claimed in claim 6, wherein the support (32) is pivoted to a fixed part (10) of the mechanism, a rotatable crank (30) being coupled by an arm (31) to the support (32) so as to cause the support (32) to perform said rocking motion upon rotation of the crank (30).

8. A sheet transfer mechanism as claimed in claim 1, wherein the transfer mechanism includes two spaced frame parts (10, 11), the elongate member (15) being mounted on one frame part (11) and projecting towards the other frame part (10), and the elongate element (13) being mounted on the other frame part (10) and projecting towards the one frame part (11).

9. A sheet transfer mechanism as claimed in claim 8, wherein there is provided a lay-shaft (16) extending through the two frame parts (10, 11) and coupled by respective non-slip drive trains (17, 19; 18, 20) to the elongate element (13) and elongate member (15).

10. A sheet transfer mechanism as claimed in claim 9, wherein the lay-shaft (16) serves to mount the transfer mechanism for pivoting movement with respect to a principal frame.

11. A sheet transfer mechanism as claimed in claim 10, wherein both outer ends of the lay-shaft (16) are provided with respective bearings (23, 24), which bearings are mounted on the principal frame.

12. A sheet transfer mechanism, comprising:

an elongate element adapted to operate on the corner region of a stack of sheets, a suction port being provided in a region of the elongate element which region generally faces uncounted sheets in the stack;

means to apply suction to said port to separate a next sheet to be counted from the stack and draw said next sheet on to the elongate element;

an elongate member arranged to extend substantially parallel to said elongate element; and mounting means for said elongate member to cause said elongate member to orbit around the elongate element thereby to transfer sheets from one side of the elongate element to the other side thereof, which mounting means comprises:

a carrier defining first, second and third parallel axes, the elongate member being disposed along said first axis;

a link pivotally connected to the carrier about said second axis which link is also pivoted to a fixed part of the mechanism; and a rotatable crank drivingly coupled to the carrier about said third axis whereby rotation of the crank causes the elongate member to perform said orbiting motion.

13. A sheet transfer mechanism as claimed in claim 12, wherein the first, second and third axes are arranged in a generally isosceles triangular configuration.

14. A sheet transfer mechanism as claimed in claim 13, wherein the throw of the crank is of the order of one third to one half of any of the effective length of the link and the spacing between any pair of said axes defined by the carrier.

15. A sheet transfer mechanism as claimed in claim 13, wherein the line of projection of the link from the carrier is generally in the same direction as a line connecting the third axis and the one axis.

* * * * *